US005992042A

United States Patent [19]

Mitchell et al.

[11] Patent Number: 5,992,042

[45] Date of Patent: Nov. 30, 1999

[54] DRYER AND METHOD FOR DRYING HARVESTED VEGETABLES

[75] Inventors: Josh Mitchell; Stephen F. Griffin, both of Monterey, Calif.

[73] Assignee: Griffin Produce, Inc., Salinas, Calif.

[21] Appl. No.: 09/197,342

[22] Filed: Nov. 20, 1998

[51] Int. Cl.[6] ..... F26B 17/24

[52] U.S. Cl. ..... 34/319; 34/318; 34/58; 99/511; 494/33

[58] Field of Search ..... 34/319, 318, 328, 34/322, 58, 60; 99/511; 494/33, 36, 84; 210/781, 361

[56] References Cited

U.S. PATENT DOCUMENTS

| | | | |
|---|---|---|---|
| 2,452,638 | 11/1948 | Drum et al. | 34/58 |
| 3,447,544 | 6/1969 | Esteban de Vergara | 134/60 |
| 4,310,119 | 1/1982 | Culhane et al. | 34/58 |
| 4,493,156 | 1/1985 | Siegmann | 34/319 |
| 5,027,530 | 7/1991 | Vollmer et al. | 34/58 |
| 5,212,876 | 5/1993 | Berit | 34/58 |
| 5,282,319 | 2/1994 | Casquilho et al. | 34/8 |
| 5,310,102 | 5/1994 | Hougham | 224/267 |
| 5,316,778 | 5/1994 | Hougham | 426/324 |
| 5,647,140 | 7/1997 | Hudspeth | 34/58 |
| 5,675,905 | 10/1997 | Hougham | 34/58 |
| 5,802,733 | 9/1998 | Hougham | 34/58 |

FOREIGN PATENT DOCUMENTS

| | | | |
|---|---|---|---|
| 78 10182 | 4/1978 | France | A23N 13/00 |

*Primary Examiner*—Henry Bennett
*Assistant Examiner*—Pamela A. Wilson
*Attorney, Agent, or Firm*—J. William Wigert, Jr.; Crosby, Heafey, Roach & May

[57] ABSTRACT

A drying apparatus and method is described wherein baskets, or totes, filled with produce to be dried, are stacked vertically within an inner support frame. The totes are arranged with the open tops facing upwardly. The inner support frame has top and bottom spindles or shafts which are rotationally supported by bearing structures at the top and bottom of the dryer body. Moisture is driven from the enclosed procuce by centrifugal force when the inner support frame/totes are rotated. Produce such as whole head vegetables are preferably arranged in rows in the totes with the cores or cut ends of a row of produce juxtapositioned with, or "butted" against, the cut ends of another row, with the leafy ends generally pointing away from the axis of rotation. In this position, water or moisture tends to flow outwardly from the leafy open ends when the inner frame is rotated during a drying operation.

9 Claims, 4 Drawing Sheets

DRYER AND METHOD FOR DRYING HARVESTED VEGETABLES

FIELD OF THE INVENTION

The present invention relates to dryers, and in particular, to centrifugal dryers used to dry wet produce such as lettuce, leafy vegetables and the like.

RELATED ART

In the field produce such as lettuce, leafy and other vegetables, are harvested both by hand and by mechanized equipment. Produce cut in the field is often put into, transported, and stored in containers or baskets, often referred to as "totes". Typically, theses totes are made of plastic, are constructed to have multiple openings in the sides and bottom, and are open at the top where the produce is put into the tote.

The harvested produce is transported to a production facility where, among other things, the produce is washed, dried, weighed, trimmed, packaged and shipped. During the washing phase produce is typically emptied from the individual totes and washed in bulk. Afterwards, the produce must be dried before the remaining steps. In some drying operations, the produce is dried in bulk. But it is convenient if the produce can be re-introduced into standard totes for drying and subsequent processing.

In U.S. Pat. No. 5,675,905, a dryer is described where produce is dried while stored in totes. The totes are arranged such that one side of each of the totes rests in contact with a turntable assembly. Thus, the perforated bottom wall of each of the totes is oriented to face away from the verticle spin axis of the turntable assembly. So when the turntable spins, water flows out of the vertically oriented bottoms of each of the totes.

In this arrangement, the open top of each of the totes faces inwardly towards the spin axis. This means that produce can spill out of the totes while they are on the turntable assembly since they are sitting on their sides and their tops are open. To overcome this problem, an optional lid is described which can be added to the tote. See column 4, lines 24–26.

SUMMARY OF THE INVENTION

In accordance with the present invention baskets, or totes, filled with produce to be dried, are stacked vertically on a rotatable turntable assembly within an inner support frame. The totes are arranged with the open tops facing upwardly. A worker, to load the totes in the dryer, simply slides each tote within the inner frame with one on top of the other. The inner support frame has top and bottom spindles or shafts which are rotationally supported by bearing structures at the top and bottom of the dryer. Moisture is driven out by centrifugal force when the inner support frame/totes are rotated.

More particularly, a centrifugal dryer for drying produce which is stored in totes is provided which has an outer dryer body which has a top and bottom, an outer body opening, and a door for enclosing the outer body opening during the operation of the dryer. As will be explained below, the top of the outer dryer body also has a spindle support bearing.

An inner frame is provided for supporting and enclosing a plurality of stacked tokes. The inner frame has three sides and an open side secured by a door. When this opening is is aligned with the outer body opening, a plurality of tokes can be placed and stacked within the frame. A motor and motor drive are provided for rotating the inner frame about its axis during operation of the dryer.

Top and bottom spindle shafts are attached at the top and bottom of the inner frame. These shafts are aligned co-axially and define the rotational axis of the device. The top and bottom spindles are rotatably supported by spindle support bearings provided, respectively, in the top and bottom of the outer body. A door is provided for closing the opening in the inner frame after the totes have been stacked within the frame.

In accordance with another aspect of the invention, a method and apparatus for drying of washed produce, such as whole head lettuce, characterized by having a core or cut end, and an open leafy end, is provided. Such produce is sometimes referred to as whole head lettuce or whole head vegetables. Such produce is normally washed and dried manually rather than mechanically. In accordance with this aspect of the invention, such types of harvested whole head vegetable produce, after being washed, is loaded into one or more individual baskets or totes.

In the preferred embodiment of the invention, one or more totes are filled with produce having a cut end and an open, leafy end. Preferably a plurality of totes are stacked and secured in a rotatable manner within a mechanical dryer. The stack of totes, which are rectangular in shape, are centered on or near the rotational axis with in an inner frame or framework. The frame is provided with top and bottom spindle shafts which are supported in bearing supports. The inner frame is rotated so that moisture in the produce is centrifugally forced out of the produce.

In the preferred embodiment, produce such as whole head vegetables are arranged in a preferred manner in the totes for the drying operation. Specifically, rows of produce are arranged in the totes with the cores or cut ends of a row of produce juxtapositioned with, or "butted" against, the cut ends of another row, with the leafy ends generally pointing away from the axis of rotation. In this position, water or moisture tends to flow outwardly from the leafy open ends when the inner frame is rotated.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENT

Figure 1:
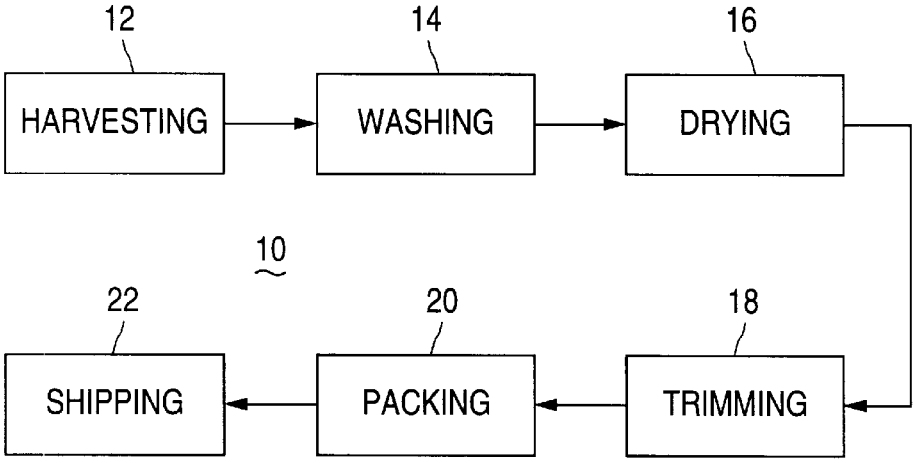
FIG. 1 is a flow chart for processing harvested produce such as lettuce and other leafy vegetables.

FIG. 1 is a flow diagram 10 for processing harvested produce such as lettuces, leafy vegetables, whole head and other vegetables, which will sometimes, collectively be referred to as "produce". By "leafy vegetables" it is meant that family of specialty lettuces and other leafy greens which, when mixed together for sale and consumption are sometimes referred to as "spring mix," "mixed greens," or "baby greens." For example, this includes lettuces, such as green romaine, red romaine, sierra, lola rosa, tango, green leaf, rced leaf, little gem, red butter, read oak, red perella and green perella. It also includes greens such as arugula, mizuna, red mustard, green mustard, spinach, tatsoi, red chard and red russian kale.

Figure 2A:
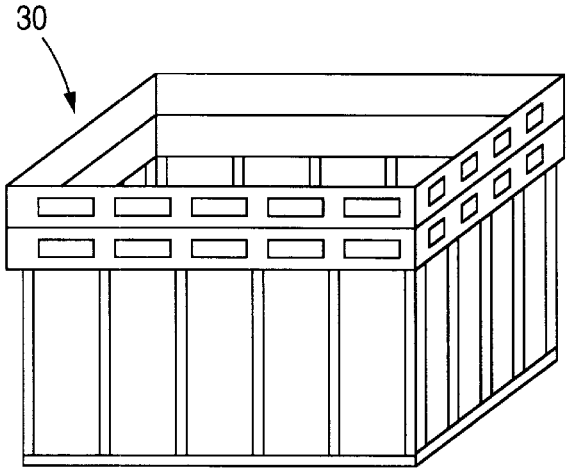
FIG. 2A is a perspective view of a standard basket or tote used to transfer harvested vegetables and FIG. 2B is a top view of a tote loaded with a vegetable such as whole head vegetables.
Figure 2B:
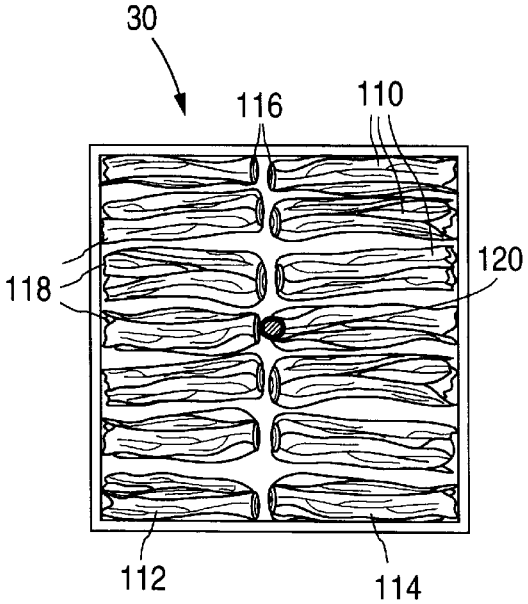

After the produce is harvested, as indicated at 12, the produce is sent to a plant for processing. This is typically accomplished by transporting the produce in standard baskets frequently referred to as "totes". FIG. 2A is a perspective view of a standard basket or tote 30 used to transfer harvested vegetables and FIG. 2B is a top view of a tote loaded with vegetables, such as whole head vegetables, as an example. As can be seen, totes 30 have a generally rectilinear shape. In the plant the produce is either processed or cooled in a vacuum tunnel and then stored for a short period of time, up to two days.

The produce is then unpacked from the totes and washed in a produce washing machine. The next step 16 is to dry the moist produce. As explained above, some drying machines dry the produce in bulk, while others, such as that shown in U.S. Pat. No. 5,675,905, dry the produce while the produce is stored in totes. Mechanically washing some kinds of vegetables, such as whole head lettuce and other vegetables is difficult to dry mechanically. After drying, the totes are delivered to stations for trimming, if necessary, as indicated at 18. Any damaged or broken leaves are also removed. For whole head products the core is removed or trimmed. After weighing, the trimmed produce is then packed as indicated at 20. Produce is frequently packed in plastic bags or in cardboard boxes. At this point the produce is ready for shipment, as indicated at 22.

Figure 4:
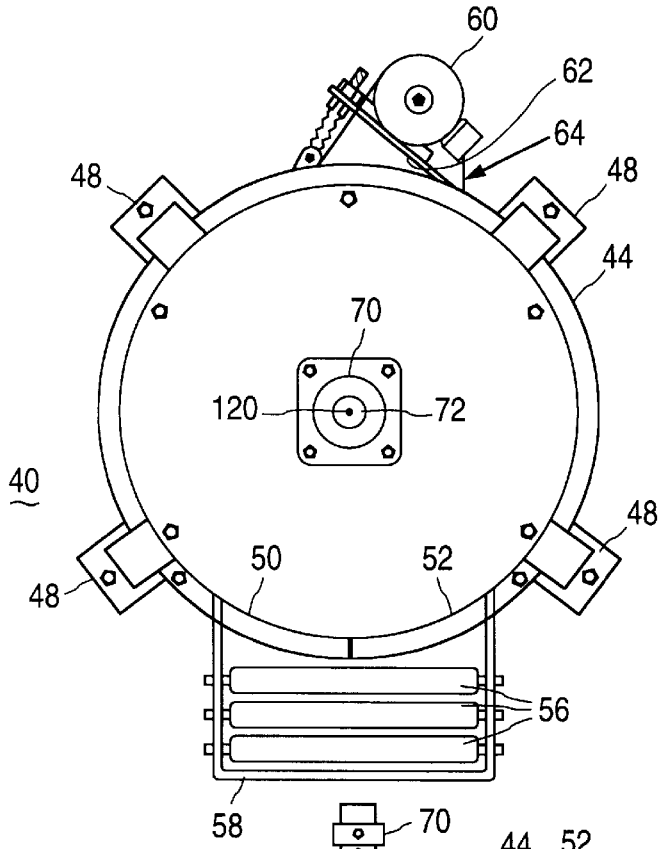
FIG. 4 is a top view of the dryer of FIG. 3.
Figure 3:
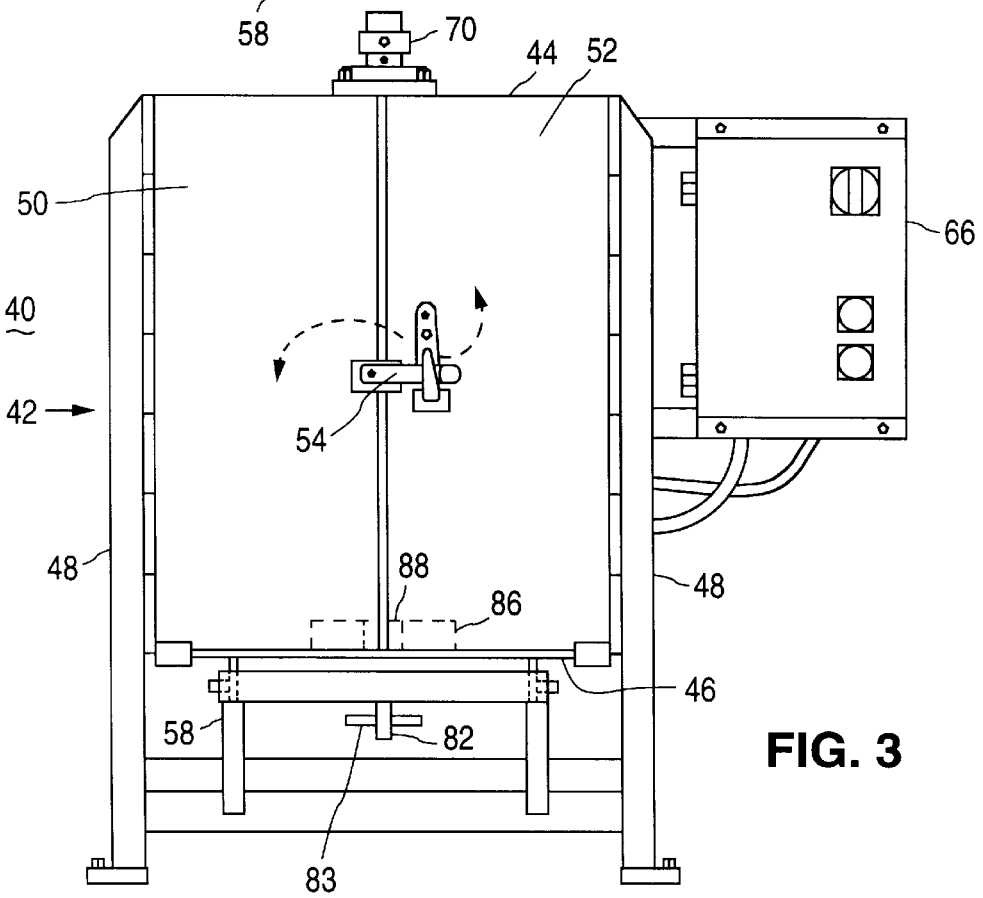
FIG. 3 is a front elevation view of a dryer in accordance with the present invention.

FIG. 3 is a front elevation view, and FIG. 4 is a top view, of a dryer 40 in accordance with the present invention. The dryer 40 has an outer body 42 having a top 44 and a bottom 46. Body 42 is supported by legs 48. A pair of doors 50 and 52 clcse an opening in the front of outer body 42. The doors are provided with a suitable latching mechanism 54. The doors are open when the dryer is being loaded and closed during a drying operation. A plurality of first rollers 56 are mounted by a bracket 58 to the dryer 40. Rollers 56 facilitate the loading of dryer 40 with a stack of totes 30.

Rotation of the produce-carrying totes 30 is accomplished by the use of a motor 60 attached by a support structure 62 to dryer 40. The motor is provided with a coupling device, such as a V-belt, or preferably, a cleated belt 64. The motor drives rotates the inner body 80 (FIGS. 5 and 6) and the enclosed totes 30. This is accomplished by coupling the cleated belt 64 to a pulley 83 attached to the lower spindle shaft 82 (FIGS. 5 and 6).

A control panel 66 is provided for controlling the operation of dryer 40. A conventional inverter and timer are provided within the control panel 66 to control the duration and revolutions per minute. It is important that the dryer dry the produce thoroughly by turning at an adequate speed, for an adequate period of time, while preventing excess mechanical damage from drying the produce too vigorously. The duaration, and speeds of rotation must be empirically determined for each type of produce being dried.

A spindle shaft support 70 is provided at the top of outer body 42. A bearing 72 is provided as a part of support 70. As will be explained below, support 70 anchors and permits rotation of the inner frame containing the totes.

Figure 5:
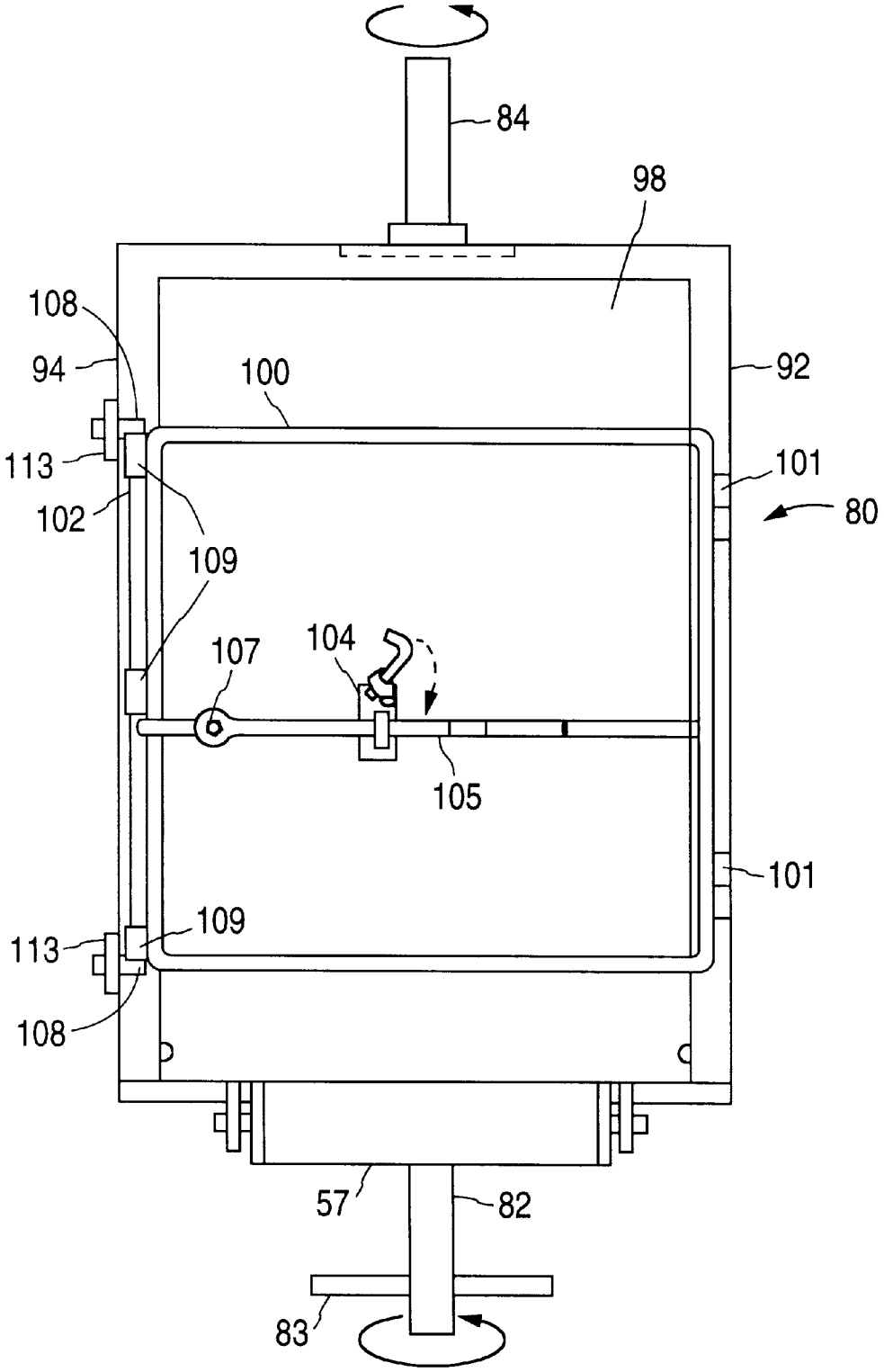
FIG. 5 is a front elevation view of the inner frame of the dryer of FIG. 3.
Figure 6:
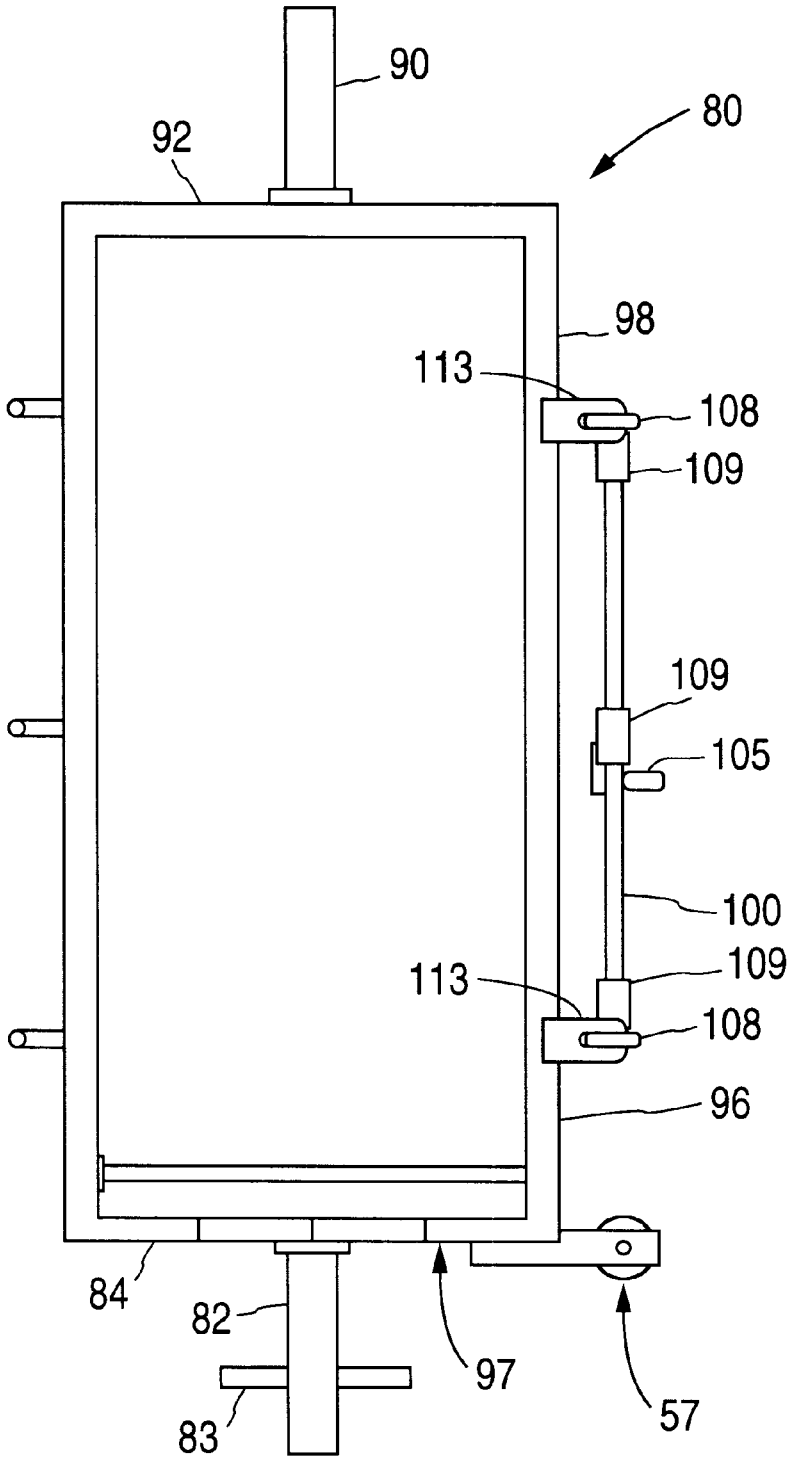
FIG. 6 is a side view of the inner frame of FIG. 5.

FIG. 5 is a front elevation, and FIG. 6 is a side view of the inner frame 80 of the dryer of FIG. 3. Inner frame 80 both supports and secures a stack of totes filled with produce during the drying operation. As can be seen, innner frame 80 has a generally rectilinear shape which conforms to a vertical stack of totes 30. A lower spindle shaft 82 is connected to the bottom 84 of the inner frame. Spindle shaft 82 is supported by spindle support structure 86 having a central bearing 88 (FIG. 3). An upper spindle shaft 90 is attached to the top 92 of inner frame 80. The shaft 90 is rotationally supported by spindle shaft support 70 arid bearing 72 (FIGS. 3 and 4) on dryer body 42. A second roller assembly 57 is connected to the inner frame 80 and is aligned with the first roller 56 assembly to facilitate the placement of totes within the inner frame. Rollers 56 and 57, in one actual embodiment, have a 2 ½ inch diameter and are made of stainless steel.

Inner frame 80 has three sides 92, 94 and 96 and a front opening 98 through which the totes 30 are inserted. It also has a bottom 97 which supports the totes. Bottom 97 is made of ½ inch plate steel, in one actual embodiment. While the totes, preferably, are first stacked and then inserted within inner frame 80, they can be inserted and stacked individually. A door 100 is rotatably attached to the inner frame by a hinge assembly 101. When the door is closed, it completes the enclosure of the stack of totes.

The inner door latching mechanism operates as follows. To open the door, a latch 104 is pivoted upwardly. This allows the operator to pivot lever 105 upwardly about pivot hinge 107. Vertical shaft 102 is held in place by three guide sleeves and is terminated at each end by hooks 108 which, when the door is closed, are engaged by securing eyes 113. When the operator rotates vertical shaft 102 about its axis this unhooks hooks 108 from securing eyes 113. In this position the door may be opened, pivoting about the hinge 101. The process is reversed to close and secure door 100.

The inner frame preferably is made of stainless steel. In one embodiment the frame is formed by 1¼ inch channels and the door is formed by ½ inch diameter tubing. The outer body 42 is made of stainless steel sheet metal.

Referring to FIG. 2B, it has been found that when drying whole head vegetables 110, there is a preferred way to place them in the totes 30. First and second rows 112 and 114 are formed with the cut or core ends 116 generally abutted or juxtapositioned to each other with the leafy ends 118 facing outwardly, relative to the axis of rotation 120. Of course, the totes 30 are filled in layers of rows to fill them. It should also be understood that filling the totes in an actual production facility does not require a high degree of precision so there is no requirement that individual heads precisely abut each other.

Although the present invention has been shown and described with respect to preferred embodiments, various changes and modifications are deemed to lie within the spirit and scope of the invention as claimed. The corresponding structures, materials, acts, and equivalents of all means or step plus function elements in the claims which follow are intended to include any structure, material, or acts for performing the functions in combination with other claimed elements as specifically claimed.

What is claimed is:

1. A centrifugal dryer for drying produce which is stored in totes comprising:

an outer dryer body having a top and bottom, an outer body opening, a door for enclosing the outer body opening during the operation of the dryer, and top and bottom spindle supports located in the top and bottom of the dryer body;

an inner frame having an opening which can be aligned with the outer body opening so that a plurality of tokes can be placed and stacked within the inner frame;

spindle shafts attached at the top and bottom of the inner frame which define an axis of rotation and which are rotatably supported by the top and bottom spindle supports, respectively;

a motor for rotating the inner frame about the rotational axis; during operation of the dryer; and a door for closing the opening in the inner frame after the totes have been stacked within the frame.

2. A centrifugal dryer as in claim 1 wherein the totes are rectangular in shape and the inner frame is also rectangular and conforms to the shape of a stack of totes.

3. A centrifugal dryer as in claim 2 wherein the produce is whole head vegetables having cut ends and leafy ends which are placed within the totes in rows wherein the cut ends are generally adjacent to each other and the leafy ends extend outwardly in a direction generally away from the axis of rotation.

4. A method of drying washed produce characterized by a core end, and an open leafy end, comprising the steps of:

loading the produce into a plurality of individual totes;

stacking the plurality of individual totes vertically within an enclosure wherein a stack of the totes is centered on a rotational axis; and rotating the enclosure about the rotational axis so that moisture is centrifugally forced out of the produce.

5. A method as in claim 4 wherein the produce is arranged in two rows within each tote, with the core ends generally abutting and with the open ends oriented away from the rotational axis.

6. A method as in claim 5 including the additional step of enclosing the stacked totes within a dryer body.

7. A centrifugal dryer for drying produce which is stored in totes comprising:

an inner frame having a vertical axis for supporting one or more totes stacked vertically therein and centered generally along the vertical axis;

an outer body for enclosing the inner frame;

means for rotatably supporting the inner frame within the outer body about the vertical axis; and means for rotating the inner frame to centrifugally force moisture from the produce stored within the totes.

8. A centrifugal dryer as in claim 7 wherein the totes are rectangular in shape and the inner frame is also rectangular and conforms to the shape of a stack of totes.

9. A centrifugal dryer as in claim 8 wherein the produce is whole head vegetables having cut ends and leafy ends which are placed within the totes in rows wherein the cut ends are generally adjacent to each other and the leafy ends extend outwardly in a direction generally away from the axis of rotation.

* * * * *